US005806329A

United States Patent [19]

Taira et al.

[11] Patent Number: 5,806,329

[45] Date of Patent: Sep. 15, 1998

[54] AIR CONDITIONER AND WASHING OPERATION THEREOF

[75] Inventors: Shigeharu Taira; Youichi Oonuma, both of Kusatsu, Japan

[73] Assignee: Daikin Industries, Ltd., Osaka, Japan

[21] Appl. No.: 817,774

[22] PCT Filed: Oct. 24, 1995

[86] PCT No.: PCT/JP95/02181

§ 371 Date: Apr. 24, 1997

§ 102(e) Date: Apr. 24, 1997

[87] PCT Pub. No.: WO96/12921

PCT Pub. Date: Feb. 5, 1996

[30] Foreign Application Priority Data

Oct. 25, 1994 [JP] Japan ..... 6-299143

[51] Int. Cl.[6] ..... F25B 45/00

[52] U.S. Cl. ..... 62/149; 62/190; 62/208; 62/228.5; 62/292

[58] Field of Search ..... 62/77, 84, 85, 62/149, 190, 208, 228.1, 228.3, 225.8, 231, 157, 292, 468, 470, 503

[56] References Cited

U.S. PATENT DOCUMENTS 4,698,983 10/1987 Hechavarria ..... 184/105.1

*Primary Examiner*—John M. Sollecito

[57] ABSTRACT

An air conditioner which includes ports (22, 23, 24) provided on portions in a refrigerant circuit where oil are liable to gather, such as bottoms of a compressor (1), accumulator (5), a receiver (12) and the like, through which ports a refrigerant is extracted and charged. The air conditioner is further provided with a control unit (50) for controlling washing operation for the refrigerant circuit, such that at the time of washing of the refrigerant circuit, washing operation is continued under the control of the control unit (50) for a predetermined period of time while increasing a frequency of the compressor (1) so as to, for example, make a temperature in a discharge pipe (2) higher than a predetermined value, and then is stopped, and the washing operation is resumed after a fixed period of time. In the air conditioner, washing of the refrigerant circuit is efficiently and effectively performed by repeatedly staring and stopping the operation of the compressor (1) predetermined times within a predetermined period of time. After washing, the refrigerant and an oil are replaced through ports (22, 23, 24).

43 Claims, 6 Drawing Sheets

A
B
Control unit
50
52
From Te
From TC1,TC2
From P1
To 50
TC2
TC1
P1
P2
P3
P4
P5
P6
P7
P8
P9
INV
SV
M
Te S1
Washing-operation mode switch ON Initialize counter and timer
S2
Te≧T1?
NO
YES
S3
Cooling mode
S4
Heating mode
S6
Increase operational frequency
S5
Td>T2 or Tc>T2?
NO
YES
S7
N=1 and t>60 (min.) or 2≦N≦n1 and t>10 (min.) ?
NO
YES
S8
Halt (3 min.)
S9
N>n1?
NO
YES
S10
Alarm display
S11
Operation stop (system down)

AIR CONDITIONER AND WASHING OPERATION THEREOF

TECHNICAL FIELD

The present invention relates to an air conditioner which can perform washing operation for removal of impurities within a refrigerant circuit, and to a method of controlling the washing operation.

BACKGROUND ART

In recent years, destruction of the ozone layer due to chlorine-containing refrigerants such as HCFC (hydrochlorofluorocarbon) 22 ($CHClF_2$), which have conventionally been used in air conditioners and refrigerators, has become a great issue. As a result, HFC (hydrofluorocarbon) alternative refrigerants containing no chlorine have come to be used in place of HCFC 22 as a measure for preventing the destruction of the ozone layer.

As for the refrigerator oil, there is a need of using those matching the refrigerant used together. The refrigerator oil for use with the HFC refrigerants is exemplified by synthetic oils (for example, ester, ether, alkyl benzene oil and the like).

However, when such a synthetic oil is used as the refrigerator oil, unlike mineral oils that have conventionally been used, care must be taken about residual impurities other than the refrigerator oil and the refrigerant (i.e., contaminants, including residual oils such as cutting oil, rolling oil, tube-expanding oil and process oil which remain in the refrigerant circuit, as well as residual foreign matters such as metal wear powder and polymer). This is because these residual impurities may cause clogging or other malfunction of pressure reducing equipment (for example, small-diameter tubes such as capillary tubes and electro-expansion valves). Therefore, for systems with an HFC refrigerant and a synthetic oil employed, it has been a common practice to perform a flushing operation, i.e., a washing operation for the interior of the refrigerant system of the equipment in order to eliminate residual impurities.

However, since no effective method of washing operation has been yet established, equipment having such a special operation mode as washing operation mode has not been available, either. Accordingly, hitherto, the washing has been accomplished through an operation continued for an appropriate period of time in forced cooling operation mode or forced heating operation mode. Upon completion of the washing operation, components such as the compressor in which oil is liable to gather and residual impurities are contained in larger quantities, are removed from the system, and the oil is taken out of the removed components, thereby residual impurities are discharged. Further, new oil is re-charged and, finally, the removed components are assembled again to the system. However, it was often that only a very small quantity of residual impurities was discharged so that the refrigerant circuit was erroneously decided to be insufficiently washed. In such a case, the above sequence of work was repeated several times in order to remove the residual impurities to below a control level.

Since the conventional washing of the refrigerant circuit was done blindly as seen above, it was often that the washing operation was performed for a long time resulting in a problem that much time was required for washing. Further, because troublesome removal and re-assembly of components were needed at each time of discharge of residual impurities, i.e., oil replacement, much time was needed for the elimination of residual impurities eventually. In the conventional method, not only that the oil is replaced each time the washing operation is performed, but also that the residual-impurities eliminating work comprises many steps as described above, which required high costs. In addition to these problems, the conventional method has a problem of increased man-hours for development tests such as reliability test and evaluation test.

DISCLOSURE OF THE INVENTION

The present invention has been accomplished in view of these problems. An object of the present invention is therefore to provide an air conditioner and a method of controlling washing operation thereof, capable of performing the washing operation with good efficiency and in short time, accomplishing the impurities-removal work simply, and improving the reliability by enhancing the washing effect.

In order to accomplish the above object, the present invention provides an air conditioner in which a compressor, a condenser, an expansion mechanism and an evaporator are connected to one another in sequence to form a closed refrigerant circuit through which a refrigerant is circulated, characterized in that a port for extracting and charging oil is provided at a portion within the refrigerant circuit where oil is liable to gather.

According to this invention, since the port exclusively for extracting and charging oil is provided at a portion in which oil is liable to gather, oil replacement work associated with the removal of impurities becomes easier to carry out and shorter in working time, as compared with the conventional method.

Portions where oil is liable to gather are typically bottom portions of the compressor, accumulator, receiver, and the like.

Also, the present invention provides a washing operation controlling method for an air conditioner in which a compressor, a condenser, an expansion mechanism and an evaporator are connected to one another in sequence to form a closed refrigerant circuit through which a refrigerant is circulated, characterized by repeating a starting and stopping of operation of the compressor predetermined times within a predetermined period of time during a washing operation.

An air conditioner to carry out the above washing operation controlling method has a control unit for controlling the compressor to repeat a starting and stopping of operation predetermined times within a predetermined period of time.

Prior to making the present invention, the present inventors investigated the product washing effect by taking the operating time, the number of starting/stopping of operation, and the discharge temperature in the refrigerant circuit as parameters. As a result, it was found that increasing the number of times of starting/stopping of operation rather than prolonging the operating time leads to a greater washing effect. The present invention is based on these investigation results. Therefore, according to the present invention, residual impurities present in the refrigerant circuit can be eliminated in shorter time than by the conventional method, and yet the washing effect is improved. Since the washing time can be reduced, it becomes possible to reduce the cost. Also, by the improvement in the washing effect, it becomes possible to improve the reliability of pressure reducing equipment such as capillary tubes and electro-expansion valves as well as to protect the compressor.

Further, the investigation results conducted by the present inventors have indicated that when the discharge pressure (which can be converted into a discharge temperature) is increased, the differential pressure between the higher and lower sides of the compressor increases proportionally thereto, so that the residual impurities accumulated in the motor of the compressor become more likely to be pushed out. Based on this investigation result, in a washing operation controlling method according to an embodiment, either pressure or temperature is detected at a predetermined position in the refrigerant circuit, and with respect to one time of operation, the operation of the compressor is continued while controlling an operational frequency of the compressor so that the pressure or temperature becomes higher than a predetermined value, and thereafter the operation is stopped for a predetermined period of time.

The pressure or temperature at the predetermined position may be a pressure or temperature within a discharge pipe connected to the compressor, or a pressure or temperature within the condenser. In an embodiment, by detecting pressure or temperature within the discharge pipe connected to the compressor as well as pressure or temperature within the condenser, the frequency of the compressor is controlled so that the pressure or temperature of either one of the discharge pipe or the condenser becomes higher than the predetermined value.

In order to carry out this method of controlling washing operation, the air conditioner in an embodiment comprises a sensor means for detecting temperature or pressure of the discharge pipe and/or the condenser. Since the temperature and the pressure can be converted into each other, the sensor to be used may be a temperature sensor or a pressure sensor. In this air conditioner, the control unit comprises first decision means for deciding whether or not an output from the sensor is greater than the predetermined value, and operational frequency increasing means for controlling an operational frequency controller to increase an operational frequency of the compressor when the first decision means has decided that the output from the sensor is equal to or lower than the predetermined value. The control unit further comprises starting/stopping control means for controlling the compressor to continue an operation until a predetermined time elapses after the operation starts, and thereafter to stop the operation for a predetermined period of time. Thus, by means of the first decision means, the operational-frequency control means and the starting/stopping control means, the control unit of the air conditioner continues the operation of the compressor for the predetermined period of time while controlling the frequency of the compressor so that the pressure or temperature at the predetermined position of the refrigerant circuit becomes greater than a predetermined value, and thereafter stops the operation for the predetermined period of time, with respect to one time of operation. The starting and stopping of the operation of the compressor by the starting/stopping control means is repeated predetermined times.

In a washing operation controlling method according to another embodiment, a differential pressure between a higher side pressure and a lower side pressure of the compressor is determined, and with respect to one time of operation, the operation of the compressor is continued while a frequency of the compressor is controlled so that the differential pressure becomes higher than the predetermined value, and thereafter the operation is stopped for a predetermined period of time.

An air conditioner for carrying out this method comprises sensors for detecting the higher-side pressure and the lower-side pressure of the compressor. Also, the control unit comprises second decision means for, upon receipt of outputs from the sensors, deciding whether or not a differential pressure between the higher side pressure and the lower side pressure is greater than a predetermined value, and operational-frequency increasing means for controlling an operational frequency controller to increase an operational frequency of the compressor when the second decision means has decided that the differential pressure is equal to or lower than the predetermined value. Further, the control unit comprises starting/stopping control means for controlling the compressor to continue an operation until a predetermined time elapses after the operation starts, and thereafter to stop the operation for a predetermined period of time. Thus, by means of the second decision means, the operational-frequency control means and the starting/stopping control means, the control unit of this air conditioner continues the operation of the compressor for the predetermined period of time while controlling the frequency of the compressor so that the differential pressure between the higher and lower sides of the compressor becomes greater than the predetermined value, and then stops the operation for the predetermined period of time, with respect to one time of operation. The starting/stopping of the operation of the compressor by the starting/stopping control means is repeated predetermined times.

In an embodiment, the air conditioner further comprises a four way valve provided in the refrigerant circuit for switching over the circuit between a cooling operation and a heating operation, and an outside air temperature sensor for detecting an outside air temperature. And the control unit comprises third decision means for deciding whether or not an output from the temperature sensor is equal to or higher than a predetermined temperature, and operation mode control means for controlling the four way valve based on the decision result. The operation mode control means controls the four way valve in such a way that when the third decision means has decided that outside air temperature is equal to or higher than the predetermined value, the washing operation is performed in the cooling mode, and when it has been decided that the outside air temperature is lower than the predetermined value, the washing operation is performed in the heating mode.

BEST MODE FOR CARRYING OUT THE INVENTION

Figure 1:
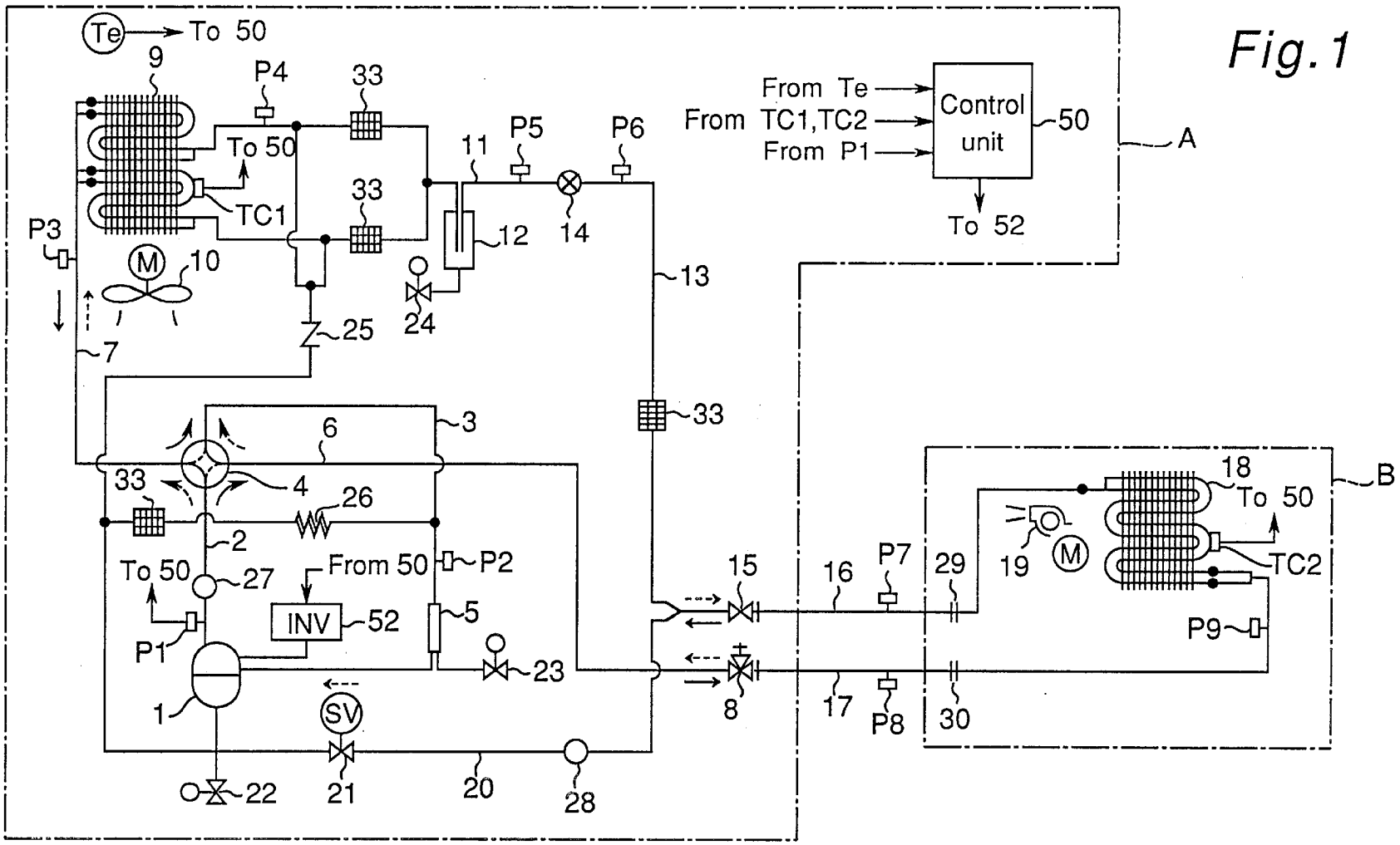
FIG. 1 is a refrigerant circuit diagram of an air conditioner according to an embodiment of this invention.

Now a concrete embodiment of the air conditioner of the present invention is described in detail with reference to the accompanying drawings. FIG. 1 shows a diagram of a refrigerant circuit in this embodiment. Referring to the figure, reference characters A and B denote an outdoor unit and an indoor unit, respectively.

The outdoor unit A is equipped with a compressor 1, and an inverter 52 is connected to the compressor 1. The inverter 52 controls the operational frequency of the compressor 1 under the control of a control unit 50.

A discharge pipe 2 and a suction pipe 3 of the compressor 1 are connected to a four way valve 4. An accumulator 5 is interposed on the suction pipe 3. A first gas tube 6 and a second gas tube 7 are connected to the four way valve 4. An outdoor heat exchanger 9 is connected to the second gas tube 7, while a propeller fan 10 is attached to the outdoor heat exchanger 9. Also, a first liquid tube 11, a receiver 12 and a second liquid tube 13 are sequentially connected to the outdoor heat exchanger 9, and an electro-expansion valve 14 is interposed on the first liquid tube 11. A liquid closing valve 15 and first field piping 16 are sequentially connected to the second liquid tube 13. Meanwhile, a gas closing valve 8 and second field piping 17 are sequentially connected to the first gas tube 6. An indoor heat exchanger 18 is connected between the first field piping 16 and the second field piping 17, and a cross-flow fan 19 is attached to the indoor heat exchanger 18. Further, the second liquid tube 13 and the first liquid tube 11 are connected to each other via a de-frosting bypass tube 20, and a solenoid valve 21 is provided on the de-frosting bypass tube 20.

In FIG. 1, reference numeral 25 denotes a check valve, 26 denotes a capillary tube, 27 and 28 denote mufflers, 29 and 30 denote single union pipe joints, respectively, 33 denotes a filter, and M denotes a motor. Also, P1 through P9 denote pressure sensors, Te denotes a temperature sensor for measuring an outdoor temperature, TC1 and TC2 denote temperature sensors attached to the outdoor heat exchanger 9 and the indoor heat exchanger 18, respectively. Among outputs from the pressure sensors P1 to P9, it is the output from the pressure sensor P1 provided at the discharge pipe 2 that are used for the washing operation controlling operation in this embodiment, as will be described later. Outputs from the other sensors are used for the control during operations other than the washing operation.

In this refrigerant circuit, with the four way valve 4 switched over, the refrigerant discharged from the compressor 1 is circulated from the outdoor heat exchanger 9 serving as a condenser to the indoor heat exchanger 18 serving as an evaporator, as shown by broken arrow in the figure, whereby the cooling operation is executed. Meanwhile, the heating operation is executed by circulating the discharged refrigerant from the indoor heat exchanger 18 serving as a condenser to the outdoor heat exchanger 9 serving as an evaporator as shown by solid line in the figure.

Figure 2:
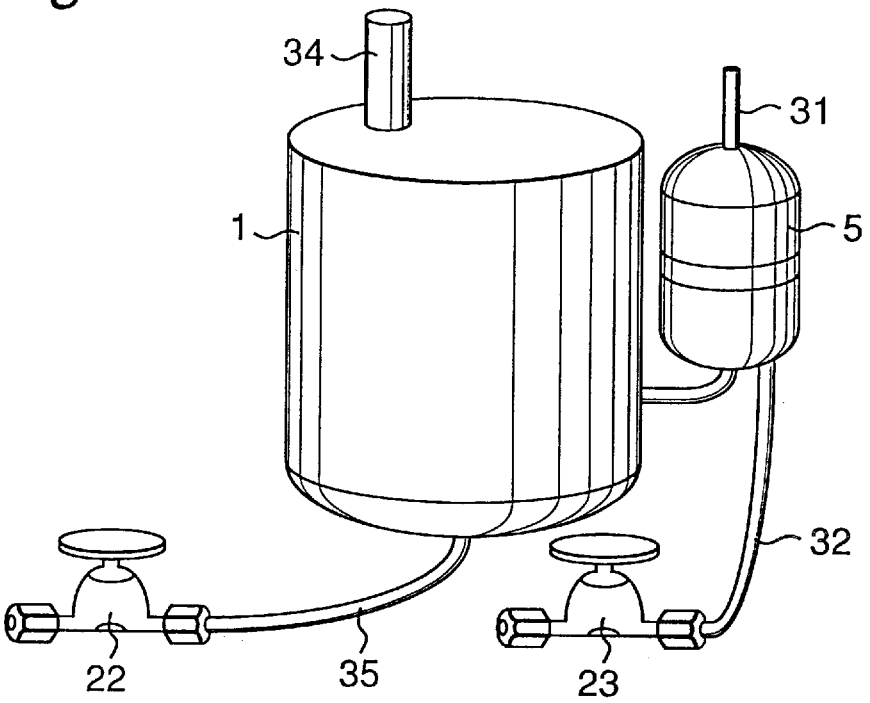
FIG. 2 is an explanatory view showing connection between the compressor as well as the accumulator and the extracting/charging ports in the embodiment of this invention.
Figure 3:
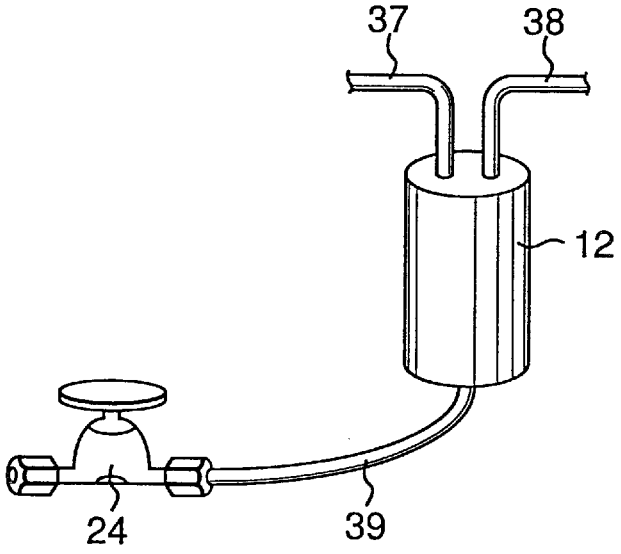
FIG. 3 is an explanatory view showing connection between the receiver and the extracting/charging port in the embodiment of this invention.

In the refrigerant circuit shown in FIG. 1, extracting/charging ports 22, 23, 24 are connected to the compressor 1, the accumulator 5 and the receiver 12, respectively. In this connection, a connecting aspect between the compressor 1, the accumulator 5 and the extracting/charging ports 22, 23 is shown in FIG. 2, while a connecting aspect between the receiver 12 and the extracting/charging port 24 is shown in FIG. 3. Referring to FIG. 2, a suction port 31 formed on top of the accumulator 5 is connected to the refrigerant circuit so that the refrigerant is sucked into it, and piping 32 is extended from the bottom of the accumulator 5 with the extracting/charging port 23 provided at its tip. A discharge port 34 formed on top of the compressor 1 is connected to the refrigerant circuit so that the refrigerant is discharged therefrom, and piping 35 is extended from the bottom surface of the compressor 1 with the extracting/charging port 22 provided at its tip. Referring to FIG. 3, suction and discharge ports 37, 38 formed on top of the receiver 12 are connected to the refrigerant circuit so that the refrigerant is sucked into and discharged from them, respectively, and piping 39 is extended from the bottom surface of the receiver 12 with the extracting/charging port 24 provided at its tip.

Next, the method of eliminating impurities remaining in the refrigerant circuit, i.e. in the system is explained. The residual impurities, as described above, include residual oils other than the refrigerator oil contained in the refrigerant system, such as cutting oil, rolling oil, tube-expanding oil and process oil, and further include residual foreign matters such as metal wear powder and polymers.

Using the refrigerant circuit of FIG. 1, the washing effect was investigated by taking the operating time, the number of times of the starting and stopping, and the discharge temperature as parameters.

Figure 4:
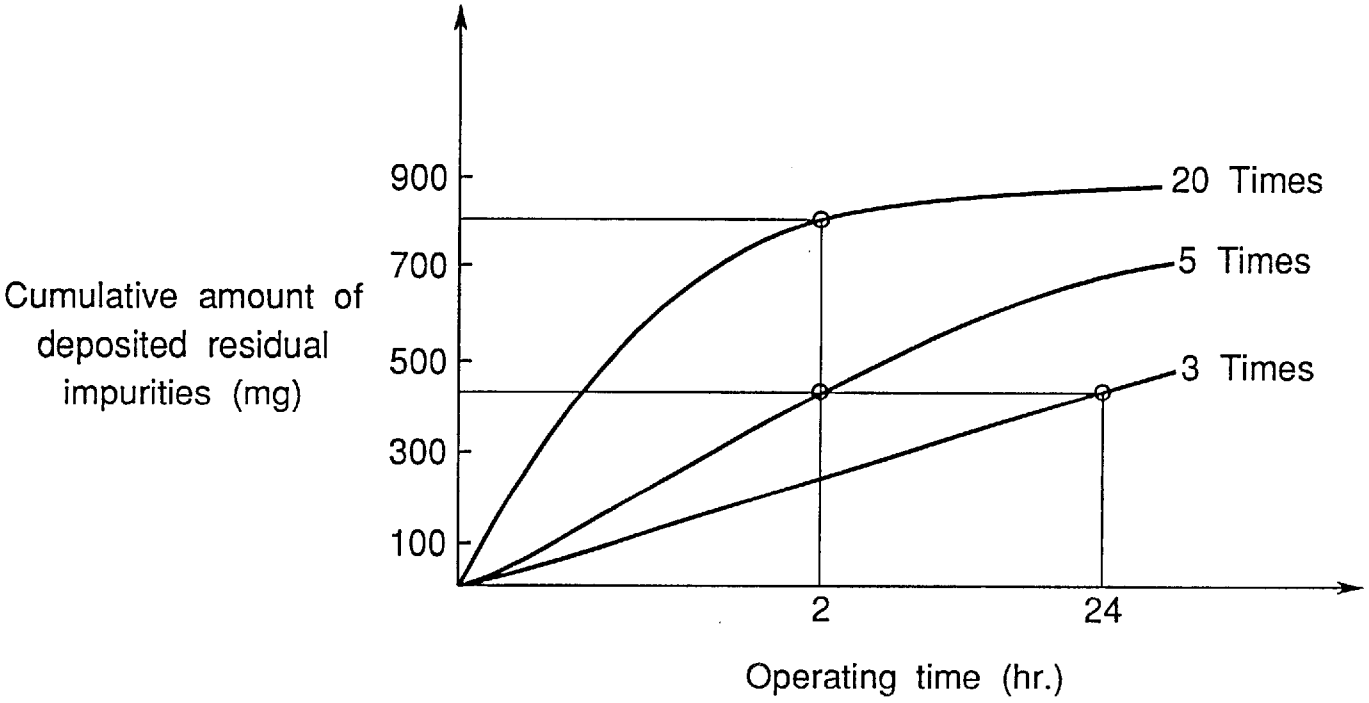
FIG. 4 is a graph showing results of investigating the product washing effect by taking, as parameters, the operating time and the number of times of the starting/stopping in the refrigerant circuit of FIG. 1.

FIG. 4 plots the washing effect in the form of cumulative amount of deposited residual impurities (mg) in the case where the parameters are given only by the operating time and the number of times of the starting and stopping. As apparent from FIG. 4, the washing effect was better when the number of times of the starting and stopping was made greater rather than when the operating time was prolonged. More specifically, the washing effect was better when the washing operation involving three times of the starting and stopping during an operating time of 24 hours was repeated three times, than when the washing operation involving twenty times of the starting and stopping during an operating time of 2 hours was repeated three times. Therefore, it was proved that increasing the number of starting and stopping times allows the residual impurities within the refrigerant system to be removed in a shorter time than by the conventional method.

Differential pressure $\Delta P$ between the discharge port 34 (higher pressure side) of the compressor 1 and the suction port 31 (lower pressure side) of the accumulator 5 is proportional to the discharge pressure. Therefore, increasing the discharge pressure made it easier to push out the residual impurities accumulated in the motor (between laminates) of the compressor 1. As a result, it was proved that increasing the differential pressure $\Delta P$ by increasing the discharge pressure is effective to enhance the washing effect.

Next, actual washing operation is explained with reference to the control flow chart of FIG. 5. Note that as shown in FIG. 6, a washing operation mode switch 41 is provided on a printed wiring board 40 of the outdoor unit A. Turning on the washing operation mode switch 41 causes the control unit 50 (see FIG. 1) to execute the following washing operation control in sequence.

For execution of the washing operation, the washing operation mode switch 41 is first turned on (step S1). In response to this, a counter (not shown) for counting the number N of times of operation and a timer (not shown) for measuring the operating time t are initialized.

Next, an outside air temperature Te measured by the temperature sensor Te is compared with a predetermined temperature T1 (step S2). If the outside air temperature Te is equal to or higher than the predetermined temperature T1, the four way valve 4 is switched to the cooling-operation side so that the washing operation is executed in the cooling mode (step S3). If not, the four way valve 4 is switched to the heating-operation side so that the washing operation is executed in the heating mode (step S4).

Subsequently, at step S5, a discharge tube temperature Td and a condensation temperature Tc are compared with a set temperature T2, respectively. If the discharge tube temperature Td or the condensation temperature Tc is equal to or lower than the set temperature T2, the inverter 52 is controlled so that the operational frequency of the compressor 1 is increased (step S6). If the discharge tube temperature Td or the condensation temperature Tc is higher than the set temperature T2, or if Td or Tc has become higher than T2 as a result of increasing the operational frequency at step S6, the program goes to step S7.

It is noted that the discharge tube temperature Td is determined by converting into a temperature a pressure detected by the pressure sensor P1 provided on the discharge pipe 2. Instead of the pressure sensor P1, a temperature sensor may be provided to directly measure the discharge tube temperature Td. Also, the condensation temperature Tc is a temperature of the outdoor heat exchanger 9 or the indoor heat exchanger 18 detected by the temperature sensor TC1 or the temperature sensor TC2 (TC1 for the cooling mode, TC2 for heating mode).

At step S7, it is decided whether or not the number N of times of operation is 1 and the operating time t is more than 60 minutes [N=1 and t>60 (min.)], or whether or not the number N of times of operation satisfies $2 \leqq N \leqq n1$ (where n1 is a set number) and the operating time t satisfies t>10 (min.). Then, if NO is answered at step S7, the program returns to step S5; if YES is answered at step S7, the program goes to step S8. That is, at the first time of operation, i.e. when the number N of times of operation is 1, the operation is continued to warm the refrigerant and oil until the operating time t exceeds 60 minutes. Further, at the second and following operations, i.e. when the number N of times of operation is 2 or more, since the refrigerant and oil have already been warmed, the operation is continued until the operating time t exceeds 10 minutes.

At step S8, the operation is stopped for three minutes, and the program goes to step S9. If the number N of times of operation is greater than the set number n1, the program goes to step S10. If the number N of times of operation is equal to or smaller than the set number n1, the program returns to step S5, where the operation is repeated.

The set number n1 is, for example, 20.

At step S10, alarm display is executed. Then, the operation is finally stopped at step S11.

Upon completion of the washing operation, the oil replacement is done at the extracting/charging ports 22, 23, 24 provided to the compressor 1, the accumulator 5 and the receiver 12. In addition, it is preferable that the extracting/charging ports 22, 23 24 have been subjected to pinch soldering or the like at the shipping time.

In the air conditioner of this embodiment, the extracting/charging ports 22, 23, 24 for extracting and charging oil are provided at portions where oil is liable to gather, such as the bottoms of the compressor 1, the accumulator 5 and the receiver 12. Therefore, there is no need of removing or re-assembling the compressor 1, the accumulator 5 and the receiver 12 themselves, so that the work of extracting and charging the oil becomes easier than before. Also, by the improvement in workability as seen above, it becomes possible to reduce the cost.

Further, in the air conditioner of this embodiment, the discharge temperature Td, the condensation temperature Tc and the operating time t are controlled to a predetermined temperature and a predetermined time, and the washing operation control in which operation/stopping are repeated predetermined times during the predetermined operating time. Thus, the residual impurities in the refrigerant circuit can be eliminated in a shorter time than before, and the washing effect can also be enhanced. In addition, cost reduction is enabled by the reduction in the washing time. Moreover, improvement in the reliability of the pressure reducing equipment, such as capillary tube and electro-expansion valve and the like, as well as the protection of the compressor is attainable by the improvement of the washing effect.

One embodiment of the present invention has been described above. However, the present invention may be embodied with changes in various ways without being limited to the above embodiment.

For example, although the extracting/charging ports 22, 23, 24 for extracting and charging oil are provided at bottom portions of the compressor 1, accumulator 5 and the receiver 12 in the foregoing embodiment, it suffices to provide such a port at any one of the above portions, or some other places in the refrigerant circuit if oil is liable to gather there. Also, the ports 22, 23, 24 are only required to be ones that allow oil to be extracted or charged and that can be opened and closed.

Figure 7:
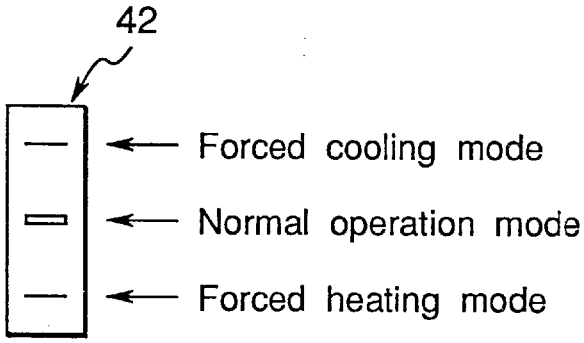
FIG. 7 shows a printed wiring board of an existing outdoor unit.

Also, in the embodiment, the washing operation mode switch 41 is on the printed wiring board 40 of the outdoor unit and the washing operation control is performed in the washing operation mode. However, alternatively, the above sequence of washing operation control may be executed by using the forced cooling or forced heating operation mode on a printed wiring board 42 of the existing outdoor unit, as shown in FIG. 7, without providing the washing operation mode switch.

Figure 5:
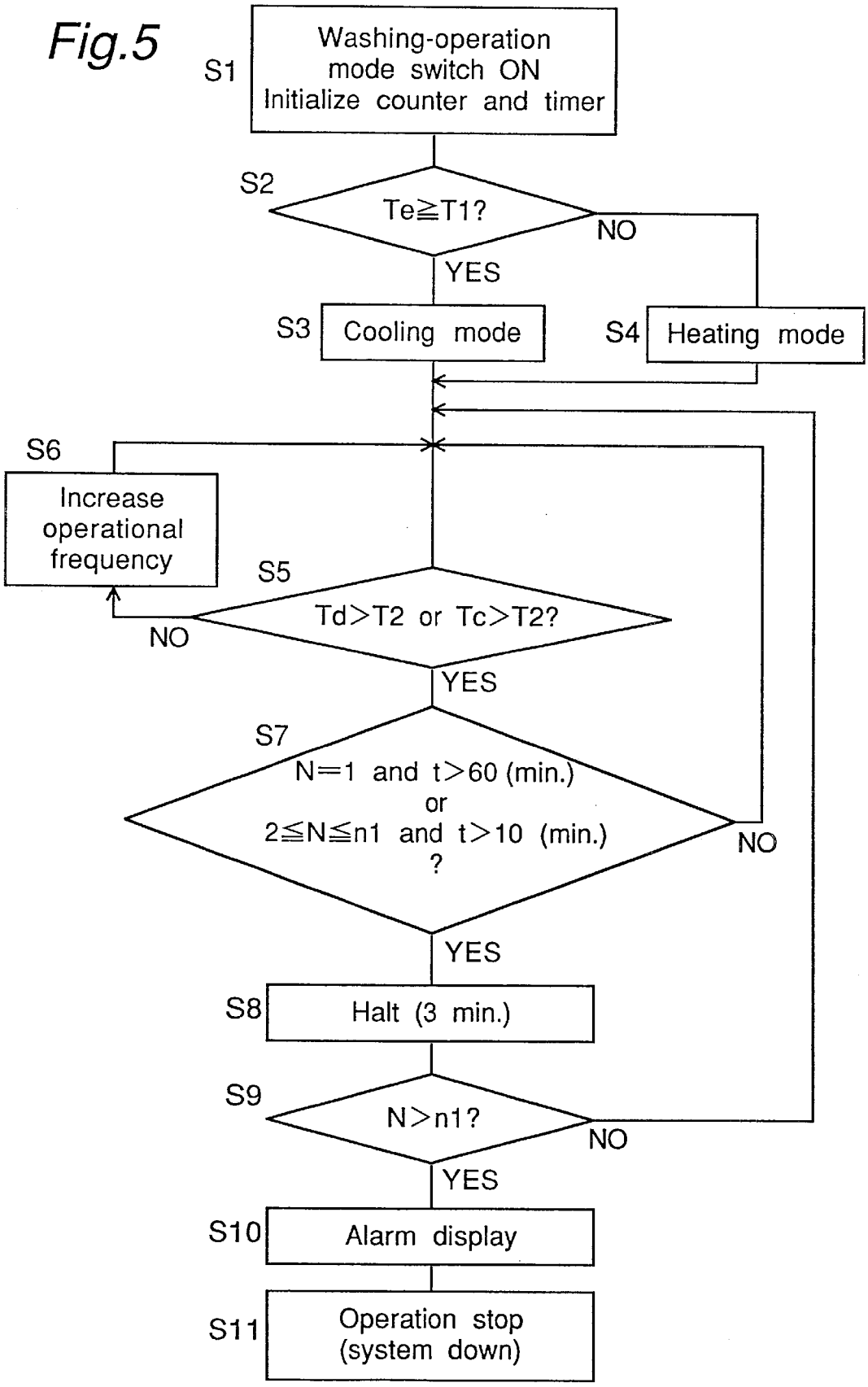
FIG. 5 is a flow chart of the washing operation control in the embodiment of this invention.
Figure 5A:
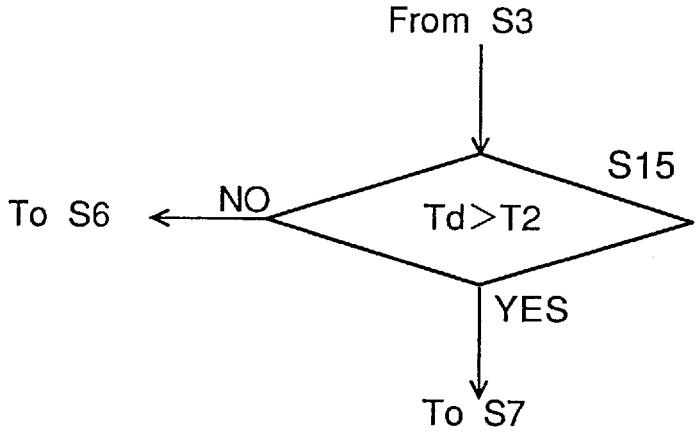
FIG. 5A and FIG. 5B illustrate variants of step S5 of FIG. 5.
Figure 5B:
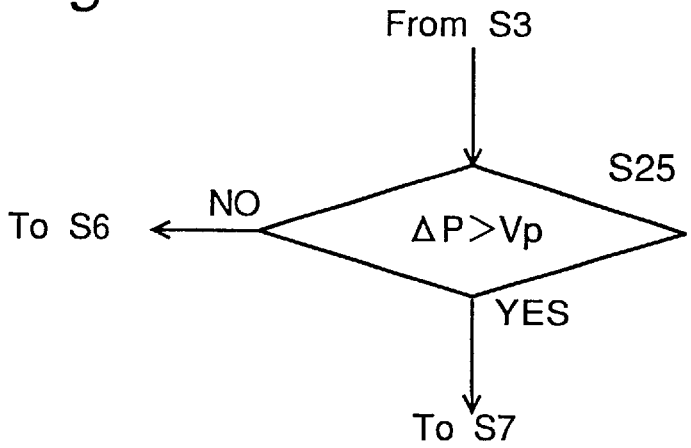
Figure 6:
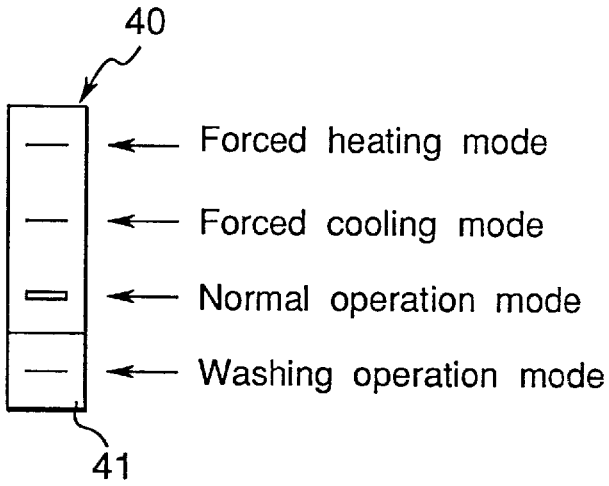
FIG. 6 shows a printed wiring board of an outdoor unit in the embodiment of this invention.

Further, in the above embodiment, both the discharge tube temperature Td and the condensation temperature Tc are detected and it is decided whether or not either of them exceeds the predetermined temperature T2 at step S5 of FIG. 5. However, the step S5 of FIG. 5 may be substituted by step S15 of FIG. 5A or step S25. That is, instead of detecting both the discharge tube temperature Td and the condensation temperature Tc, the discharge tube temperature Td only may be detected, followed by deciding whether or not the discharge tube temperature Td exceeds the set temperature T2 (step S15 of FIG. 5A). Also, instead of these, it is also possible to calculate the differential pressure ΔP between high-pressure side and low-pressure side of the compressor 1 from an output of the pressure sensor P1 of the discharge pipe 2 and an output of the pressure sensor P2 of the suction pipe 3 and then decide whether or not the differential pressure ΔP is equal to or higher than a predetermined value Vp (step S25 of FIG. 5B).

Moreover, temperature sensors may also be used instead of the various pressure sensors P1 to P9 used in this embodiment.

Industrial Applicability

The present invention is applicable to equipment having a refrigerant circuit, such as air conditioners and refrigerators.

We claim:

1. An air conditioner comprising a refrigerant circuit, the refrigerant circuit comprising: a compressor, a condenser, an expansion mechanism, an accumulator, a receiver, and an evaporator connected to one another, the refrigerant circuit including a port for extracting and charging oil provided at at least one of the accumulator and the receiver.

2. The air conditioner as claimed in claim 1, wherein the port is provided at a bottom portion of at least one of the accumulator and the receiver.

3. The air conditioner as claimed in claim 1, further comprising:

a control unit for controlling the compressor to repeatedly start and stop a predetermined number of times within a predetermined period of time when the refrigerant circuit is washed.

4. The air conditioner as claimed in claim 3, further comprising:

a sensor for detecting either pressure or temperature at a predetermined position within the refrigerant circuit, the control unit comprising:

first decision means for deciding whether an output from the sensor is greater than a predetermined value; and operational frequency increasing means for increasing a frequency of operation of the compressor when the first decision means decides that the output from the sensor is equal to or lower than the predetermined value.

5. The air conditioner as claimed in claim 4, wherein the control unit comprises compressor starting/stopping control means for controlling the compressor to continue an operation until a predetermined time elapses after the operation starts, and thereafter to stop operation for a predetermined period of time.

6. The air conditioner as claimed in claim 4, comprising a discharge pipe connected to the compressor wherein the sensor detects either pressure or temperature within the discharge pipe.

7. The air conditioner as claimed in claim 4, wherein the sensor detects either pressure or temperature within the condenser.

8. The air conditioner as claimed in claim 4, comprising a discharge pipe connected to the compressor wherein the sensor comprises a first sensor for detecting either pressure or temperature within the discharge pipe, and a second sensor for detecting either pressure or temperature within the condenser, and wherein the operational frequency increasing means controls the operational frequency controller to increase the operational frequency of the compressor if the first decision means decides that the output from either one of the first sensor or the second sensor is equal to or lower than the predetermined value.

9. The air conditioner as claimed in claim 3, further comprising:

first and second sensors for detecting a higher-side pressure and a lower-side pressure of the compressor, the control unit comprising:

second decision means for deciding, upon receipt of outputs from first and second sensors, whether or not a differential pressure between the higher side pressure and the lower side pressure of the compressor is greater than a predetermined value (Vp); and operational frequency increasing means for increasing an operational frequency of the compressor when the second decision means decides that the differential pressure is equal to or lower than the predetermined value.

10. The air conditioner as claimed in claim 9, wherein the control unit further comprises starting/stopping control means for controlling the compressor to continue an operation until a predetermined time elapses after the operation starts, and thereafter to stop operation for a predetermined period of time.

11. The air conditioner as claimed in claim 3, further comprising:

a four way valve provided in the refrigerant circuit for switching the air conditioner between a cooling operation mode and a heating operation mode; and an outside air temperature sensor for detecting an outside air temperature, the control unit comprising:

third decision means for deciding whether an output from the temperature sensor is equal to or higher than a predetermined temperature; and operation mode control means for controlling the four way valve such that if the third decision means decides that the outside air temperature is equal to or higher than the predetermined temperature, the washing operation is executed in a cooling mode, and if the outside air temperature is lower than the predetermined temperature, the washing operation is executed in a heating mode.

12. The air conditioner as claimed in claim 3, further comprising a washing operation mode switch for starting a washing operation.

13. The air conditioner as claimed in claim 2, further comprising:

a control unit for controlling the compressor to repeatedly start and stop a predetermined number of times within a predetermined period of time when the refrigerant circuit is washed.

14. The air conditioner as claimed in claim 13, further comprising:

a sensor for detecting either pressure or temperature at a predetermined position within the refrigerant circuit, the control unit comprising:

first decision means for deciding whether an output from the sensor is greater than a predetermined value; and operational frequency increasing means for increasing a frequency of operation of the compressor when the first decision means decides that the output from the sensor is equal to or lower than the predetermined value.

15. The air conditioner as claimed in claim 14, wherein the control unit comprises compressor starting/stopping control means for controlling the compressor to continue an operation until a predetermined time elapses after the operation starts, and thereafter to stop operation for a predetermined period of time.

16. The air conditioner as claimed in claim 14, comprising a discharge pipe connected to the compressor wherein the sensor detects either pressure or temperature within the discharge pipe.

17. The air conditioner as claimed in claim 14, wherein the sensor detects either pressure or temperature within the condenser.

18. The air conditioner as claimed in claim 14, comprising a discharge pipe connected to the compressor wherein the sensor comprises a first sensor for detecting either pressure or temperature within the discharge pipe, and a second sensor for detecting either pressure or temperature within the condenser, and wherein the operational frequency increasing means controls the operational frequency controller to increase the operational frequency of the compressor if the first decision means decides that the output from either one of the first sensor or the second sensor is equal to or lower than the predetermined value.

19. The air conditioner as claimed in claim 13, further comprising:

first and second sensors for detecting a higher-side pressure and a lower-side pressure of the compressor, the control unit comprising:

second decision means for deciding, upon receipt of outputs from first and second sensors, whether or not a differential pressure between the higher side pressure of the compressor and the lower side pressure is greater than a predetermined value; and operational frequency increasing means increasing an operational frequency of the compressor when the second decision means decides that the differential pressure is equal to or lower than the predetermined value.

20. The air conditioner as claimed in claim 18, wherein the control unit further comprises starting/stopping control means for controlling the compressor to continue an operation until a predetermined time elapses after the operation starts, and thereafter to stop operation for a predetermined period of time.

21. The air conditioner as claimed in claim 13, further comprising:

a four way valve provided in the refrigerant circuit for switching the air conditioner between a cooling operation mode and a heating operation mode; and an outside air temperature sensor for detecting an outside air temperature, the control unit comprising:

third decision means for deciding whether an output from the temperature sensor is equal to or higher than a predetermined temperature; and operation mode control means for controlling the four way valve such that if the third decision means decides that the outside air temperature is equal to or higher than the predetermined temperature, the washing operation is executed in a cooling mode, and if the outside air temperature is lower than the predetermined temperature, the washing operation is executed in a heating mode.

22. The air conditioner as claimed in claim 13, further comprising a washing operation mode switch for starting washing operation.

23. An air conditioner including a refrigerant circuit comprising a compressor, a condenser, an expansion mechanism, an accumulator, a receiver, and an evaporator connected to one another, the refrigerant circuit including a port for extracting and charging oil provided at at least two locations from amongst said compressor, said accumulator, and said receiver.

24. The air conditioner as claimed in claim 23, further comprising:

a control unit for controlling the compressor to repeatedly start and stop a predetermined number of times within a predetermined period of time when the refrigerant circuit is washed.

25. The air conditioner as claimed in claim 23, further comprising:

a sensor for detecting either pressure or temperature at a predetermined position within the refrigerant circuit, the control unit comprising:

first decision means for deciding whether an output from the sensor is greater than a predetermined value; and operational frequency increasing means for increasing a frequency of operation of the compressor when the first decision means decides that the output from the sensor is equal to or lower than the predetermined value.

26. The air conditioner as claimed in claim 23, wherein the control unit comprises compressor starting/stopping control means for controlling the compressor to continue an operation until a predetermined time elapses after the operation starts, and thereafter to stop operation for a predetermined period of time.

27. The air conditioner as claimed in claim 23, comprising a discharge pipe connected to the compressor wherein the sensor detects either pressure or temperature within the discharge pipe.

28. The air conditioner as claimed in claim 23, wherein the sensor detects either pressure or temperature within the condenser.

29. The air conditioner as claimed in claim 23, comprising a discharge pipe connected to the compressor wherein said sensor includes a first sensor for detecting either pressure or temperature within a discharge pipe, and a second sensor for detecting either pressure or temperature within the condenser, and wherein the operational frequency increasing means controls the operational frequency controller to increase the operational frequency of the compressor if the first decision means decides that the output from either one of the first sensor or the second sensor is equal to or lower than the predetermined value.

30. The air conditioner as claimed in claim 23, further comprising:

first and second sensors for detecting a higher-side pressure and a lower-side pressure of the compressor, the control unit comprising:

second decision means for deciding, upon receipt of outputs from first and second sensors, whether or not a differential pressure between the higher side pressure and the lower side pressure of the compressor is greater than a predetermined value; and operational frequency increasing means for increasing an operational frequency of the compressor when the second decision means decides that the differential pressure is equal to or lower than the predetermined value.

31. The air conditioner as claimed in claim 23, wherein the control unit further comprises starting/stopping control means for controlling the compressor to continue an operation until a predetermined time elapses after the operation starts, and thereafter to stop operation for a predetermined period of time.

32. The air conditioner as claimed in claim 23, further comprising:

a four way valve provided in the refrigerant circuit for switching the air conditioner between a cooling operation mode and a heating operation mode; and an outside air temperature sensor for detecting an outside air temperature, the control unit comprising:

third decision means for deciding whether an output from the temperature sensor is equal to or higher than a predetermined temperature; and operation mode control means for controlling the four way valve such that if the third decision means decides that the outside air temperature is equal to or higher than the predetermined temperature, the washing operation is executed in a cooling mode, and if the outside air temperature is lower than the predetermined temperature, the washing operation is executed in a heating mode.

33. The air conditioner as claimed in claim 23, further comprising a washing operation mode switch for starting a washing operation.

34. The air conditioner as claimed in claim 23, further comprising:

a control unit for controlling the compressor to repeatedly start and stop a predetermined number of times within a predetermined period of time when the refrigerant circuit is washed.

35. The air conditioner as claimed in claim 23, further comprising:

a sensor for detecting either pressure or temperature at a predetermined position within the refrigerant circuit, the control unit comprising:

first decision means for deciding whether an output from the sensor is greater than a predetermined value; and operational frequency increasing means for increasing a frequency of operation of the compressor when the first decision means decides that the output from the sensor is equal to or lower than the predetermined value.

36. The air conditioner as claimed in claim 23, wherein the control unit comprises compressor starting/stopping control means for controlling the compressor to continue an operation until a predetermined time elapses after operation starts, and thereafter to stop the operation for a predetermined period of time.

37. The air conditioner as claimed in claim 23, comprising a discharge pipe connected to the compressor wherein the sensor detects either pressure or temperature within the discharge pipe.

38. The air conditioner as claimed in claim 23, wherein the sensor detects either pressure or temperature within the condenser.

39. The air conditioner as claimed in claim 23, comprising a discharge pipe connected to the compressor wherein said sensor comprises a first sensor for detecting either pressure or temperature within the discharge pipe, and a second sensor for detecting either pressure or temperature within the, and wherein the operational frequency increasing means controls the operational frequency controller to increase the operational frequency of the compressor if the first decision means decodes that the output from either one of the first sensor or the second sensor is equal to or lower than the predetermined value.

40. The air conditioner as claimed in claim 23, further comprising:

first and second sensors for detecting a higher-side pressure and a lower-side pressure of the compressor, the control unit comprising:

second decision means for deciding, upon receipt of outputs from first and second sensor, whether or not a differential pressure between the higher side pressure and the lower side pressure of the compressor is greater than a predetermined value; and operational frequency increasing means for increasing an operational frequency of the compressor when the second decision means decides that the differential pressure is equal to or lower than the predetermined value.

41. The air conditioner as claimed in claim 23, wherein the control unit further comprises starting/stopping control means for controlling the compressor to continue an operation until a predetermined time elapses after the operation starts, and thereafter to stop operation for a predetermined period of time.

42. The air conditioner as claimed in claim 23, further comprising:

a four way valve provided in the refrigerant circuit for switching the air conditioner between a cooling operation mode and a heating operation mode; and an outside air temperature sensor for detecting an outside air temperature, the control unit comprising:

third decision means for deciding whether an output from the temperature sensor is equal to or higher than a predetermined temperature; and operation mode control means for controlling the four way valve such that if the third decision means decides that the outside air temperature is equal to or higher than the predetermined temperature, the washing operation is executed in a cooling mode, and if the outside air temperature is lower than the predetermined temperature, the washing operation is executed in a heating mode.

43. The air conditioner as claimed in claim 23, further comprising a washing operation mode switch for starting the washing operation.

* * * * *